US007496983B2

(12) United States Patent
Kostigian

(10) Patent No.: US 7,496,983 B2
(45) Date of Patent: Mar. 3, 2009

(54) GYMNASIUM FLOOR COVERING STORAGE AND CLEANING ROLLER

(76) Inventor: John V. Kostigian, 181 W. River Road, Cambridge, Ontario (CA) N1S 2Z9

( * ) Notice: Subject to any disclaimer, the term of this patent is extended or adjusted under 35 U.S.C. 154(b) by 0 days.

(21) Appl. No.: 12/068,762

(22) Filed: Feb. 8, 2008

(65) Prior Publication Data

US 2008/0135669 A1 Jun. 12, 2008

Related U.S. Application Data

(63) Continuation-in-part of application No. 11/085,055, filed on Mar. 22, 2005, now abandoned.

(51) Int. Cl.
*A47L 11/00* (2006.01)

(52) U.S. Cl. ..... 15/40; 15/88.1; 15/256.5; 242/557

(58) Field of Classification Search ..... 15/40, 15/88.1, 256.5; 242/557, 390.8
See application file for complete search history.

(56) References Cited

U.S. PATENT DOCUMENTS 2,913,194 A * 11/1959 Garnett ..... 242/557
4,221,344 A * 9/1980 Lohest ..... 242/477.6
4,281,802 A * 8/1981 Burley ..... 242/388.1
4,632,329 A * 12/1986 Burley ..... 242/390.8
5,013,367 A * 5/1991 Butts ..... 134/9
5,590,435 A 1/1997 Kostigian
6,739,107 B1 * 5/2004 Lewis et al. ..... 53/118

FOREIGN PATENT DOCUMENTS

CA 1090312 11/1980
CA 1304734 7/1992

* cited by examiner

*Primary Examiner*—Sang Kim
(74) *Attorney, Agent, or Firm*—Robert G Hendry

(57) ABSTRACT

The present invention relates to a floor covering storage and dispensing rack including a frame equipped with castors. Floor lock anchors are also provided on the frame. Upper frame members of the rack are in spaced parallel relation and support a roller. A motor is provided to rotate the roller for winding the floor covering onto the roller for storage. An elongated cleaning head including a pair of parallel brushes is provided on a frame member so that floor covering passing between the brushes while being retrieved or dispensed will be cleaned.

4 Claims, 3 Drawing Sheets

GYMNASIUM FLOOR COVERING STORAGE AND CLEANING ROLLER

Figure 1:
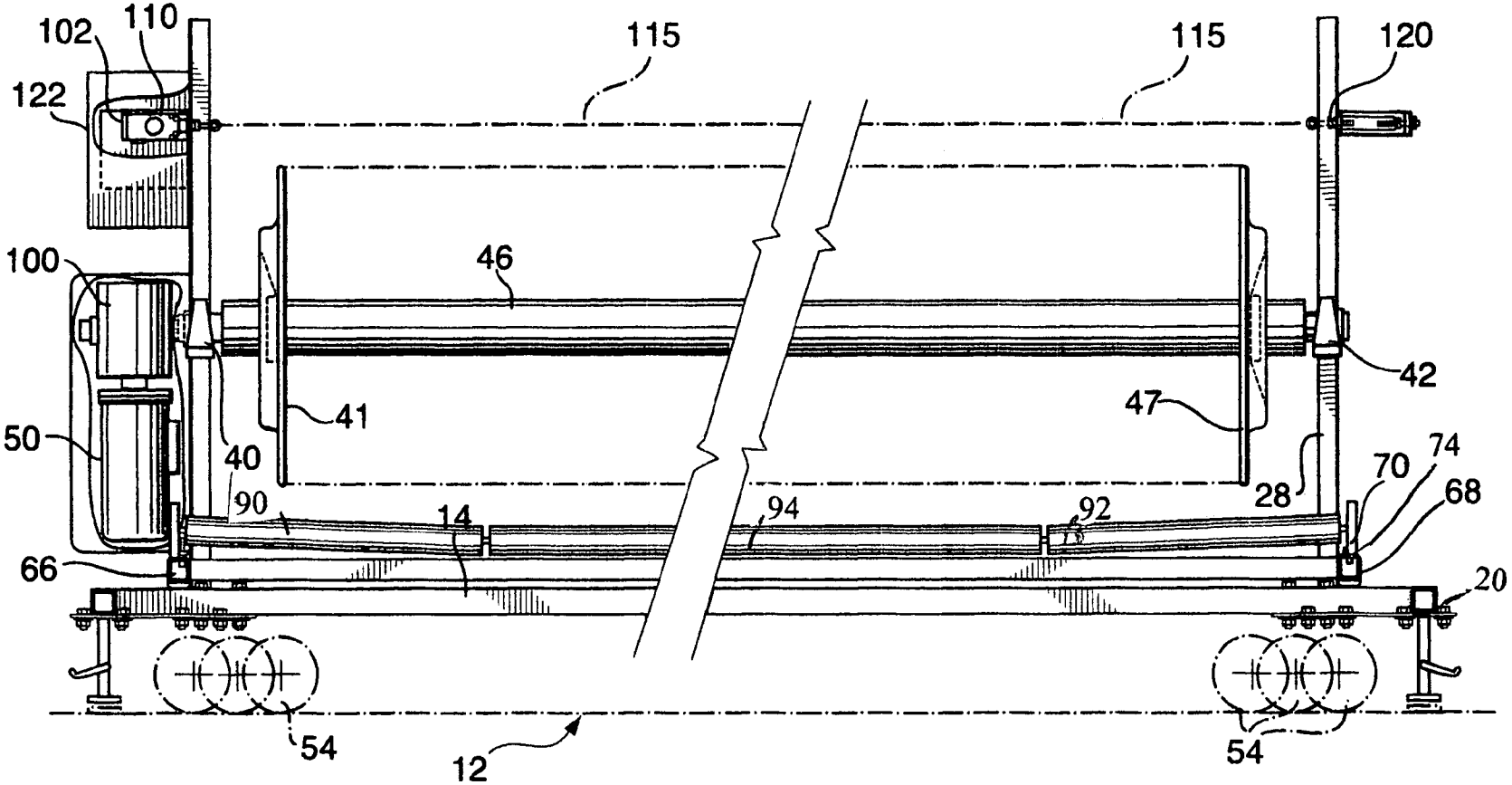

This application is a Continuation In Part of U.S. Ser. No. 11/085,055 filed Mar. 22, 2005 now abandoned. This application corresponds to Canadian Application 2,487,083 filed Nov. 8, 2004.

This invention relates to floor covering storage and dispensing racks and more particularly to a rack having brushes for removing dirt as the floor covering is returned to storage.

The use of gymnasium floors for other activities such as dances and social gatherings has always caused concern that the quality of the floor will deteriorate due to street shoes being worn during activities other than sports.

It has therefore become the practice to cover gymnasium floors with sheets of thin flooring material composed of suitable synthetic material such as vinyl. The plastic covering is stored on rolls when not in use.

Floor covering racks are well known for display and dispensing purposes. The floor covering is stored on rotatable rolls on a rack and can be conveniently withdrawn and laid on the floor. The floor covering is conveniently retrieved by rotating the roller by means of a crank or an electric motor. It has now been found that in most cases it is desirable to sweep the floor covering before returning it to the storage roll. Floor covering storing and dispensing racks available for retrieving floor covering from gymnasiums include those disclosed in Canadian Patent Nos. 1,304,734, 1,090,312 and 2,145,438

These prior devices did not entirely meet the requirements for a lightweight frame capable of storing ten rolls of floor covering one above the other on two sides of the frame. A broad base to avoid tipping is also desirable. Furthermore, roller bearing castors capable of being locked in position during retrieval of the floor covering had not been contemplated for known storage and display racks.

The present invention seeks to overcome the deficiencies of the prior devices by providing a floor covering dispensing storage and retrieval apparatus having a lightweight metal frame.

The present invention intends to overcome the deficiencies of the prior devices by providing a floor covering apparatus having an electric motor mounted on the rack to rotate a single roll of floor covering.

The present invention further seeks to provide a floor covering dispensing and retrieval apparatus having antifriction castors and floor lock anchors adapted to be locked into place during retrieval of floor covering.

The present invention seeks to provide a floor covering retrieval and dispensing apparatus having one or more cleaning heads or brushes to remove dirt from the floor covering as it is retrieved and stored.

Accordingly, the present invention provides a floor covering storage and dispensing rack comprising: a frame, lower frame members including ground engaging means and a roller for receiving floor covering supported on the sides of the frame in parallel spaced relation, means for winding the floor covering on the roller, an elongate cleaning head extending along a frame member parallel to the roll, whereby material received on said roller contacts the cleaning head as it is returned to storage on the roller of the floor covering storage rack.

Figure 2:
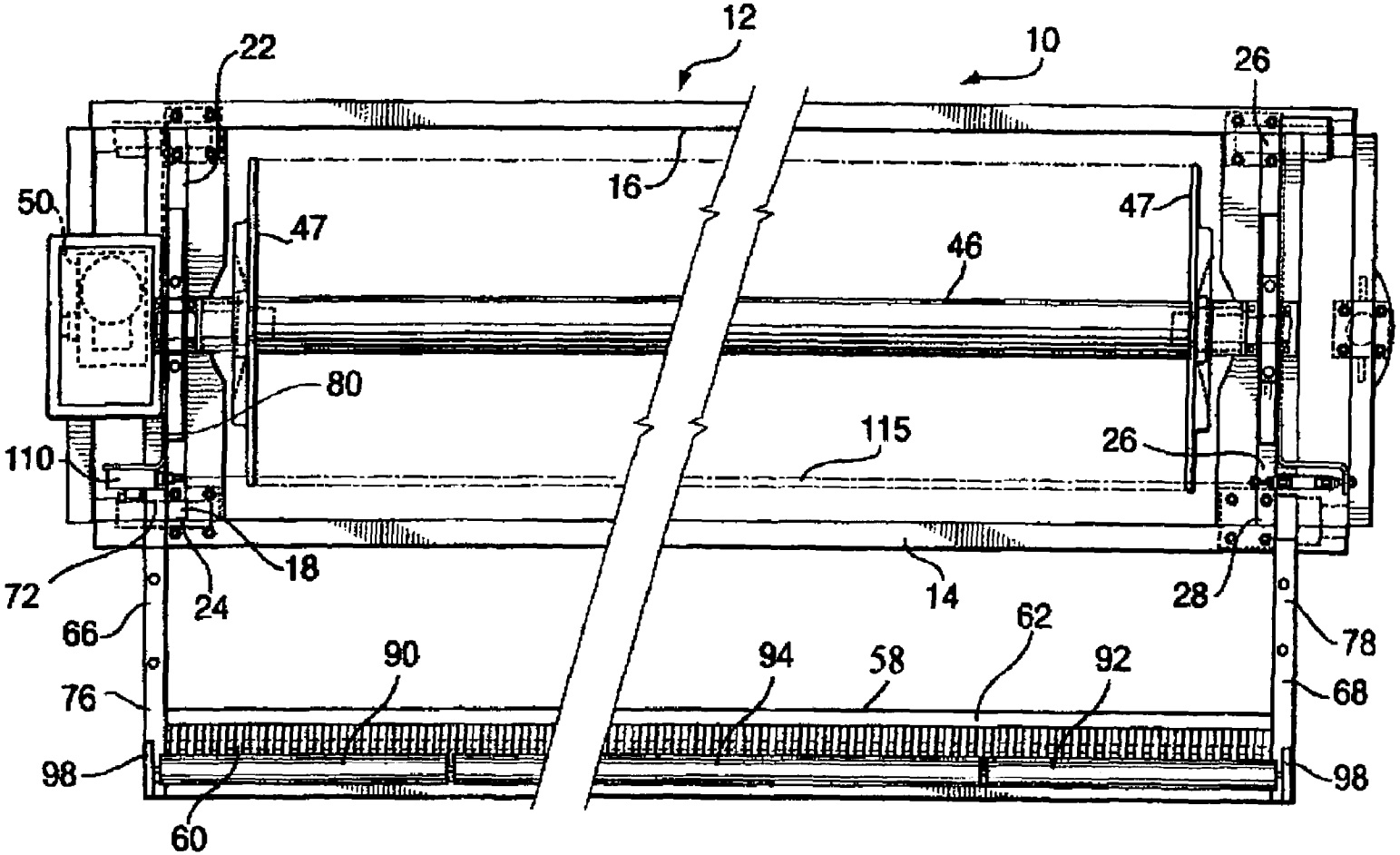
Figure 3:
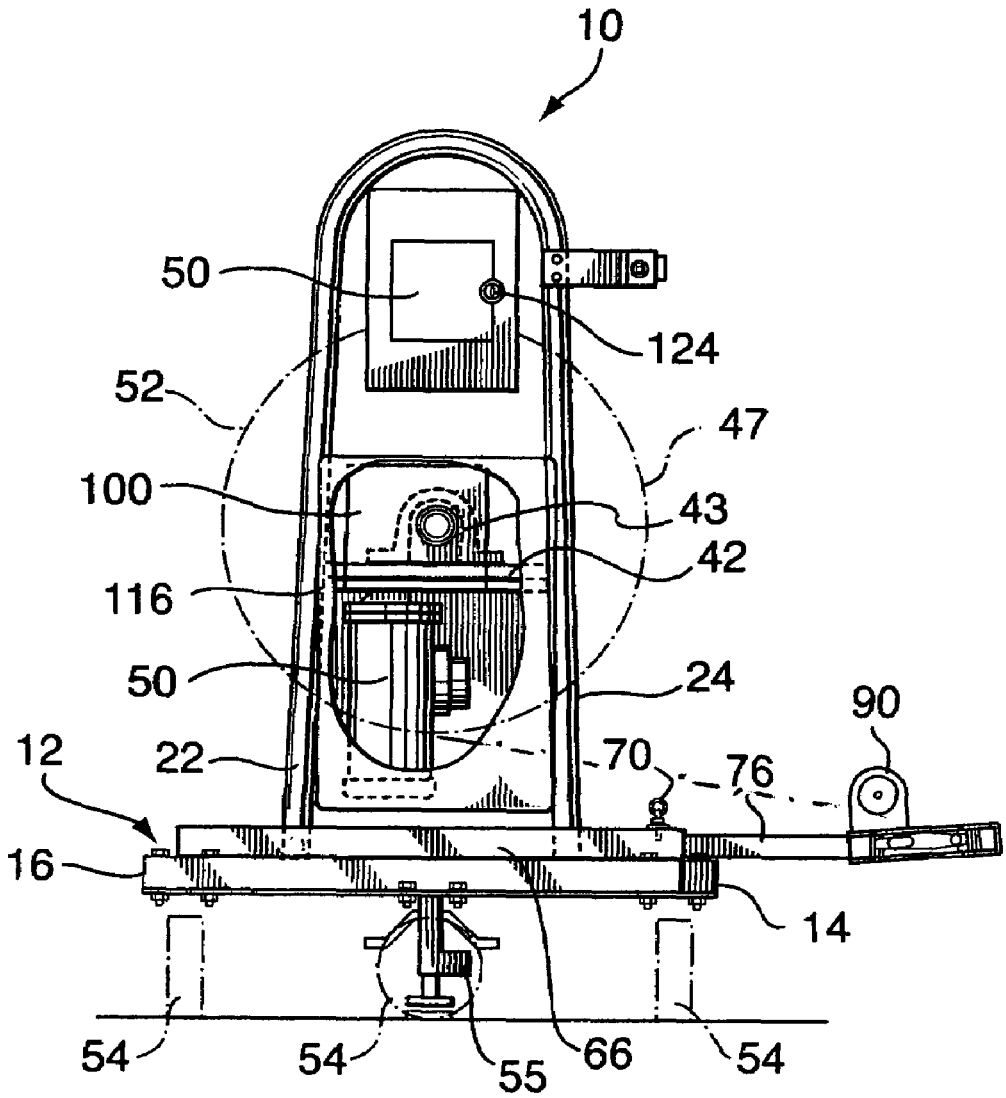

In the drawings, which illustrate embodiments of the invention:

FIG. 1 is a front elevational view of a floor covering storage and dispensing rack in accordance with this invention;

FIG. 2 is a top plan view of the floor covering storage and dispensing rack; and FIG. 3 is an end view the floor covering storage and dispensing rack., In the drawings, which illustrate an embodiment of the invention, the floor covering storage dispensing and retrieval rack is shown generally at 10 in FIG. 1, comprises a frame 12. The frame 12 is constructed of of tubular members of circular or square cross section. The frame 12 includes a rectangular base having front and rear members 14 and 16 and interconnecting side members 18 and 20. A first upright side member includes uprights 22 and 24 secured to a side member 18 in a conventional manner such as by bolts, rivets or welding and a second upright side member includes uprights 26 and 28 secured to the opposing side member 18. Ends of the uprights 22 and 24 are joined at their upper ends and the uprights 26 and 28 are joined at their upper ends.

A pair of brackets 40 and 42 are secured to the uprights 24 and 28 to support rollers 46. The end of the roller 46 provided with electrically driven cranking means.50. to provide the required torque the motor 50 is a one horse power 230V/3 pH/60 hz motor and an AC inverter 102 The Ac inverter will use 115VAC/1 pH/60 Hz power supply and convert the voltage to the 230VAC/3 pH/60 hz required thereby avoiding the requirement for 220 volt AC power not readily available in gymnasiums. A gear drive 100 on the motor 50 is a combination of hypoid gear and involute gear and provides a ratio of 120 to 1 and 2800 lbs of torque. An emergency cable pull switch 110 is provided on the motor 50. The switch 110 is operated by a cable 115, shown in broken lines in FIG. 1, having its end 120 secured to the frame 28.

The brackets 40 and 42 have roller bearings, to reduce friction and pins, not shown, extending through the roller 46 at the ends thereof limit axial movement of the roller with respect to their supporting brackets. and rollers 46. It is therefore possible to retrieve and store a roll of floor covering, exceeding 30 inches in diameter, shown at 52 in FIG. 3. The frame 12 is supported by four rubber tired castors 54 secured to the frame 12 , so that the rack 10 and floor covering 52 can be rolled from storage to floor covering laying or retrieving locations. The rack 10 is preferably provided with floor lock anchors 55 so that during the dispensing and retrieving operation, the rack 10 will remain stationary.

The floor covering rack 10 is provided with a pair of angularly disposed rollers 90 and 92 and a horizontal roller 94 there between adjacent the brushes 60 and 62 for aligning the floor covering 47 with the storage roller 46 after the floor covering has been cleaned and is being retrieved for storage.

In use, the rack 10 having been provided with up to 10 rolls of vinyl floor covering is moved from storage to a dispensing position. The floor covering is then unrolled from successive rollers by pulling on the floor covering while the castors are locked. The castors are unlocked to move the rack 10 to another dispensing position. It is optional whether or not to pass the floor covering through the brushes 60 and 62 during the dispensing operation. The floor covering retrieved and cleaned in this manner is then moved to a storage area after the castors have been unlocked.

As shown more clearly in FIG. 2, a cleaning head 58 comprising a pair of opposed brushes 60 and 62 extend along the frame member 14. The ends of bristles 64 of the brushes 60 and 62 extend towards each other and preferably abut or intermesh. The brushes 60 and 62 have mounting brackets 66 and 68, respectively, at their ends. The brackets 66 and 68 are square tubular members provided with set screws 70.

The brackets 66 and 68 also have a tubular portion 72 and 74, respectively, disposed at a right angle to the brush 60 or 62 to receive rails 76 and 78. The rails 76 and 78 are bent upwardly at their outer ends and have inner ends slideably received in square tubes 80 and 82. releasably secured to side rails 16 and 18.

In use, the rack 10 having been provided with up to 10 rolls of vinyl floor covering is moved from storage to a dispensing position. The floor covering is then unrolled from the roller by pulling on the floor covering while the floor lock anchors are locked. The anchors are unlocked to move the rack to another dispensing position. It is optional whether or not to pass the floor covering through the brushes 60 and 62 during the dispensing operation.

When the floor covering is to be retrieved, the rack 10 is positioned at one end of a strip of floor covering, so that the floor covering can be inserted through the brushes 60 and 62. Spring clips, not shown, secure the floor covering to the roller 46 as described in Canadian Patent No. 1,090,312 and the roller is rotated by the electric motor 50 adapted for this purpose.

The loose dirt on the upper surface of the floor covering will be swept to the end by the brush 62 and dirt on the underside will fall beneath the rack 10 and can be readily collected for disposal. The brushes 60, 62 and the cleaning head 58 are capable of being detached and secured along the rail 16 to clean floor covering retrieved and stored on the rollers 46 on the uprights 22 and 26. The cleaning head may also be detached and moved to other storage racks 10. After the floor covering is retrieved and cleaned, in this manner, the floor lock anchors 54 are unlocked to permit moving the rack 10 to a storage area.

The invention claimed is:

1. A rack for use in retrieving, cleaning and storing floor covering for temporarily covering a floor to be protected, said rack comprising:

a frame having a rectangular base including two side edges, a front edge and a rear edge; and a lower frame member respectively at the front edge; and a respective first and second upright sides secured each side edge of the base, the first and second upright sides being joined at an upper end of said first and second upright sides by a top rail member; and a roller rotatably mounted between the first and second upright sides in a vertically spaced, parallel relationship above the front and rear edges of the frame capable of storing up to 1000 linear feet of vinyl floor covering; and an electric motor and means for rotating the roller;

ground engaging means on the base; and an elongated cleaning head extending along the lower frame member at the front edge of the rectangular base, said cleaning head comprising a pair of mutually opposed brushes, and means for removably securing the brushes to the frame;

whereby a floor covering is passed between said mutually opposed brushes when said floor covering is returned to storage upon said selected roller by operating the means for rotating in order to clean the floor covering as it is being retrieved from the floor for storage wherein a pair of angularly disposed rollers is secured adjacent the brushes for aligning the floor covering with the storage roller after the floor covering has been cleaned and is being retrieved for storage.

2. A floor covering rack as claimed in claim 1, wherein the ground engaging means comprises wheels and floor lock anchor means is provided for preventing movement of said rack during retrieval of the floor covering.

3. A floor covering rack as claimed in claim 1 wherein the first and second upright sides include bearings to support said rollers.

4. A rack for use in retrieving, cleaning and storing floor covering for temporarily covering a floor to be protected, said rack comprising:

a frame having a rectangular base including two side edges, a front edge, and a rear edge; and a lower frame member respectively at the front edge; and a respective first and second upright sides secured each side edge of the base, the first and second upright sides being joined at an upper end of said first and second upright sides by a top rail member; and a storage roller rotatably mounted between the first and second upright sides in a vertically spaced, parallel relationship above the front and rear edges of the frame for storing a roll of floor covering three feet in diameter and an electric motor and gear means for rotating the roller; ground engaging means on the base; means for preventing movement of the rack during retrieval of the floor covering, and an elongated cleaning head extending along the lower frame member at the front edge of the rectangular base, said cleaning head comprising a cleaning material on a pair of mutually opposed cleaning material supports, and means for removably securing the cleaning material supports to the frame, whereby said floor covering is passed through said cleaning head when said floor covering is returned to storage upon said selected roller by operating the means for rotating in order to clean the floor covering as it is being retrieved from the floor for storage wherein a pair of angularly disposed rollers is secured adjacent the brushes for aligning the floor covering with the storage roller after the floor covering has been cleaned and is being retrieved for storage.

* * * * *